US006428331B1

(12) United States Patent
Yamakawa et al.

(10) Patent No.: US 6,428,331 B1
(45) Date of Patent: Aug. 6, 2002

(54) ELECTRICAL CONNECTION BOX

(75) Inventors: Shuji Yamakawa; Eriko Yuasa, both of Yokkaichi (JP)

(73) Assignee: Sumitomo Wiring Systems, Ltd., Mie (JP)

( * ) Notice: Subject to any disclaimer, the term of this patent is extended or adjusted under 35 U.S.C. 154(b) by 0 days.

(21) Appl. No.: 10/025,695

(22) Filed: Dec. 26, 2001

(30) Foreign Application Priority Data

Dec. 28, 2000 (JP) ..... 2000-402067

(51) Int. Cl.[7] ..... H01R 12/00
(52) U.S. Cl. ..... 439/76.2; 439/205
(58) Field of Search ..... 439/76.2, 199, 439/205

(56) References Cited

U.S. PATENT DOCUMENTS 4,799,893 A * 1/1989 Ogawa et al. ..... 439/76
4,959,018 A * 9/1990 Yamamoto et al. ..... 439/76
4,963,099 A * 10/1990 Sato et al. ..... 439/76.2
5,501,605 A * 3/1996 Ozaki et al. ..... 439/76.1

FOREIGN PATENT DOCUMENTS

JP U 62-172219 10/1987

* cited by examiner

*Primary Examiner*—Tho D. Ta
*Assistant Examiner*—Brigette R. Hammond
(74) *Attorney, Agent, or Firm*—Oliff & Berridge, PLC

(57) ABSTRACT

An electrical connection box for a vehicle has bus bars providing upstanding tabs acting as terminals, and relay terminals fitted on the tabs. An insulation plate overlies the bus bars. A case member is assembled on the insulation plate by relative downward movement and provides housing spaces for the relay terminals. A partitioning wall separating adjacent housing spaces makes sliding contact with an upstanding wall of the insulation plate during assembly, and the partitioning wall and the upstanding wall in the assembled state at least partly surround a liquid-receiving space. The upstanding wall having an inclined upper end face. The construction minimizes risk of a current leak between the relay terminals.

12 Claims, 5 Drawing Sheets

ELECTRICAL CONNECTION BOX

BACKGROUND OF THE INVENTION

1. Field of Invention

The present invention relates to an electrical connection box suitable for mounting on a vehicle, an industrial product such as a vehicle or robot, and more particularly an electrical connection box containing bus bars and relay terminals.

2. Description of Related Art

Electric and electronic parts for a vehicle are mounted in a vehicle body by accommodating them in or on an electrical connection box. JP-A-62-172219 shows an example of a known electrical connection box, which includes a circuit member comprising bus bars in layers, a plurality of relay terminals and a molded plastic material case. Upwardly projecting male tabs are formed by bending the bus bars and projecting them through the topmost insulating plate. The relay terminals are fitted on the male tabs. The case covers the relay terminals and has openings for terminals of a component which make contact with the relay terminals during use. In this type of arrangement there is a risk of water or other liquids penetrating into the case, leading to a possible leak current between the terminals.

SUMMARY OF THE INVENTION

Accordingly, it is an object of the present invention to provide an electrical connection box capable of preventing or minimizing the risk of current leaks caused by the penetration of water or other liquids into the case.

According to one embodiment of the invention there is provided an electrical connection box having a plurality of bus bars providing at least two upstanding tabs acting as terminals, with relay terminals fitted on the tabs. An insulation plate overlies the bus bars and has respective apertures through which the tabs project. The electrical connection box has at least one upstanding wall located between the apertures and having an inclined upper end face. The insulation plate covers a case member and is assembled on the insulation plate by a downward movement relative to the insulation plate. Walls providing respective housing spaces for the relay terminals are included in the case member. The walls include a partitioning wall separating an adjacent pair of said housing spaces.

The partitioning wall is arranged to make sliding contact with the upstanding wall during the downward movement and the partitioning wall and the upstanding wall in the assembled state at least partly surround a liquid-receiving space.

In the construction of the invention, the upstanding wall of the insulation plate stands up between the pair of tab apertures, which are close to each other. When the insulating plate and the case member are combined with each other, the upstanding wall slidably contacts the partitioning wall separating the corresponding relay terminals. In this way a direct open path does not exist between the relay terminals. Therefore the respective housing spaces accommodating the relay terminals are separate from each other. In this case, even if water or other liquid penetrates into the housing spaces, it is possible to minimize risk of a current leak being generated between the relay terminals. Any path between the relay terminals is an elongate one, including the liquid-receiving space, in which water collects and can be drained to the exterior.

Further, the inclined face at the upper end of the upstanding wall is capable of restricting or controlling the flow direction of water, or the like which flows from above, along the partitioning wall. This may also help to prevent a current leak from being generated between the relay terminals. Preferably in the assembled state, the inclined upper end face of the upstanding wall slopes upwardly away from the partitioning wall. Preferably, the insulation plate has two such upstanding walls arranged alongside each other between the apertures, and the partitioning plate is slidably received between the two upstanding walls, the liquid-receiving space being located between the two upstanding walls below the partitioning wall.

It is also preferable that the upstanding wall has a step providing a horizontal surface, at least one of the relay terminals being located on this horizontal surface. The step having the horizontal surface perpendicular to the extension direction of the male tab is formed preferably in the vicinity of the base of the upstanding wall, adjacent to the tab aperture. The relay terminals are fitted on the male tabs respectively, with one or more of the relay terminals located on the horizontal surface of the step. Therefore the relay terminals are stably located, when fitted on the male tabs. Accordingly, it is possible to reduce the possibility of deformation of the male tabs and the relay terminals, and inaccurate location of the relay terminals.

Preferably the walls of the case member further include at least one outer side wall bounding the housing spaces. The outer side wall having an inclined inner face portion which slopes upwardly and inwardly with respect to the housing spaces. In this way, water or the like which flows from above along the inner surface of the outer side wall can be discharged easily to the outside. That is, water collection in the terminal housing space is minimized.

BRIEF DESCRIPTION OF THE DRAWINGS

The invention will be described with reference to the accompanying drawings, in which like elements are labeled with like numbers and in which.

DETAILED DESCRIPTION OF PREFERRED EMBODIMENTS

Figure 1:
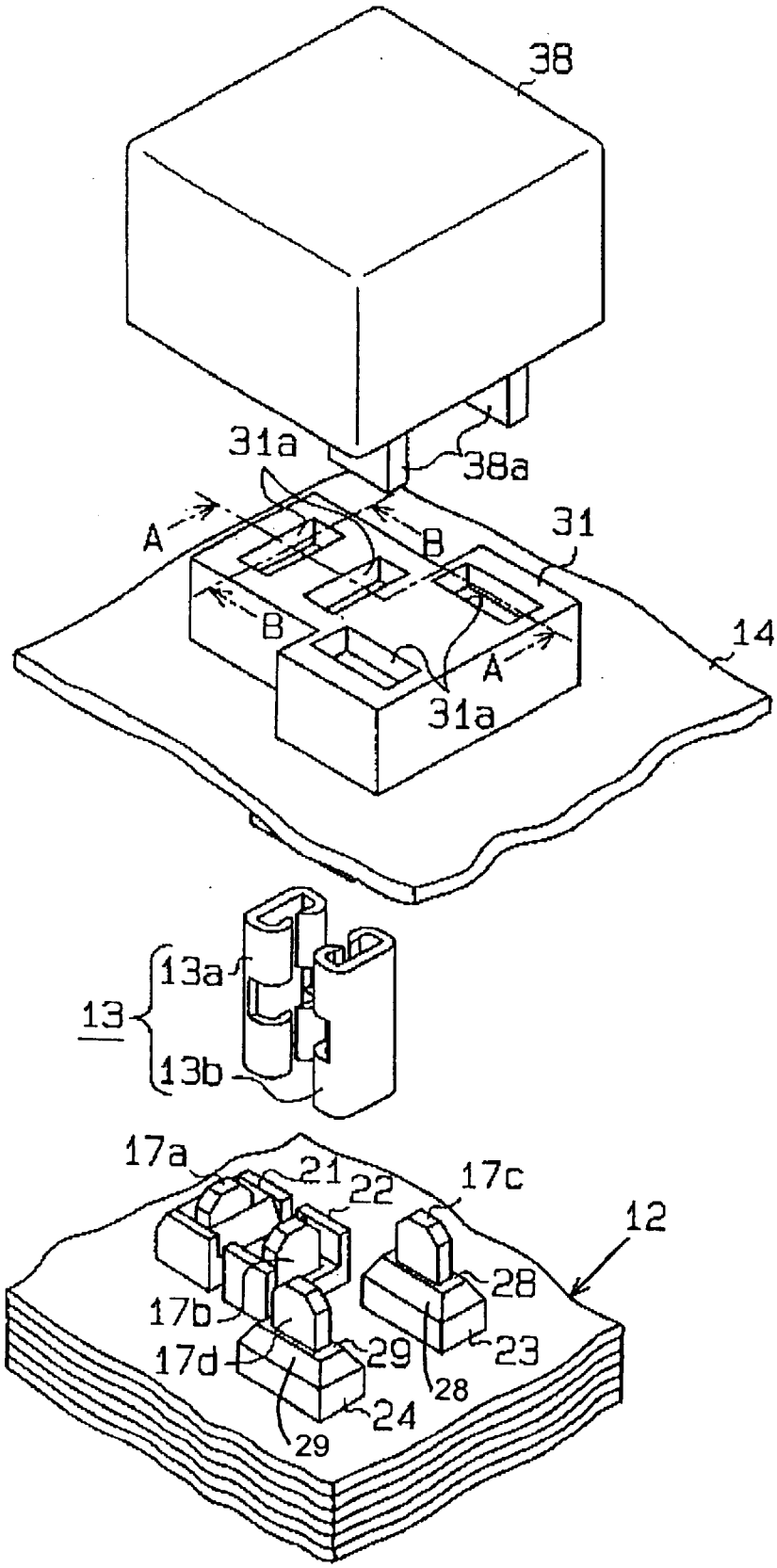
FIG. 1 is an exploded partial perspective view of an electrical connection box which is an embodiment of the present invention.
Figure 2:
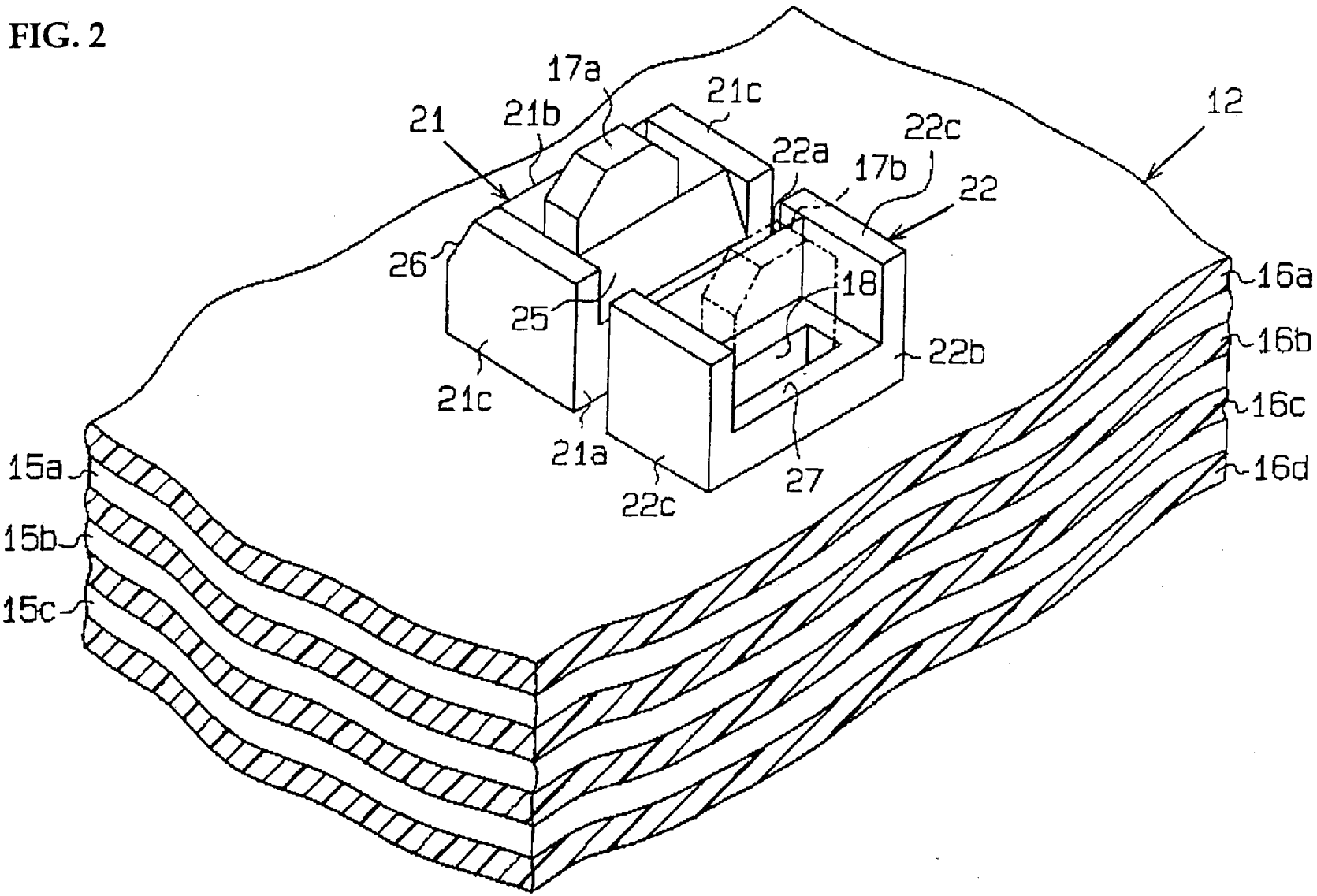
FIG. 2 is an enlarged perspective view on a part of the circuit member of the electrical connection box of FIG. 1.

An electrical connection box intended for use in a vehicle such as an automobile shown in FIGS. 1 to 5 has a circuit member 12, a plurality of relay terminals 13 of punched and bent metal (only two are shown in FIG. 1), and a molded plastics material case 14. The circuit member 12 is constructed of a plurality of layers of bus bars 15*a*–15*c* (three in this embodiment) formed of punched conductive sheet and a plurality of insulating plates 16*a*–16*d* (four in this embodiment) separating the layers of bus bars, with the topmost plate 16*a* covering the upper surface of the uppermost bus bar layer 15*a*.

Male tabs 17*a*–17*d* are formed by bending up end portions of the bus bars 15*a*–15*c*. The tabs 17*a*–17*d* extend upward through respective apertures, indicated as apertures 18*a* and 18*b* corresponding to the male tabs 17*a* and 17*d*, in the topmost plate 16*a*. The relay terminals 13 are fitted on the projecting male tabs 17*a*–17*d* and are formed to receive a male terminal at each end. The male tabs 17*a* and 17*b* and their apertures 18*a* and 18*b* are close to each other, and likewise the relay terminals 13*a* and 13*b* on the male tabs 17*a* and 17*b* are close to and confront each other.

Figure 3:
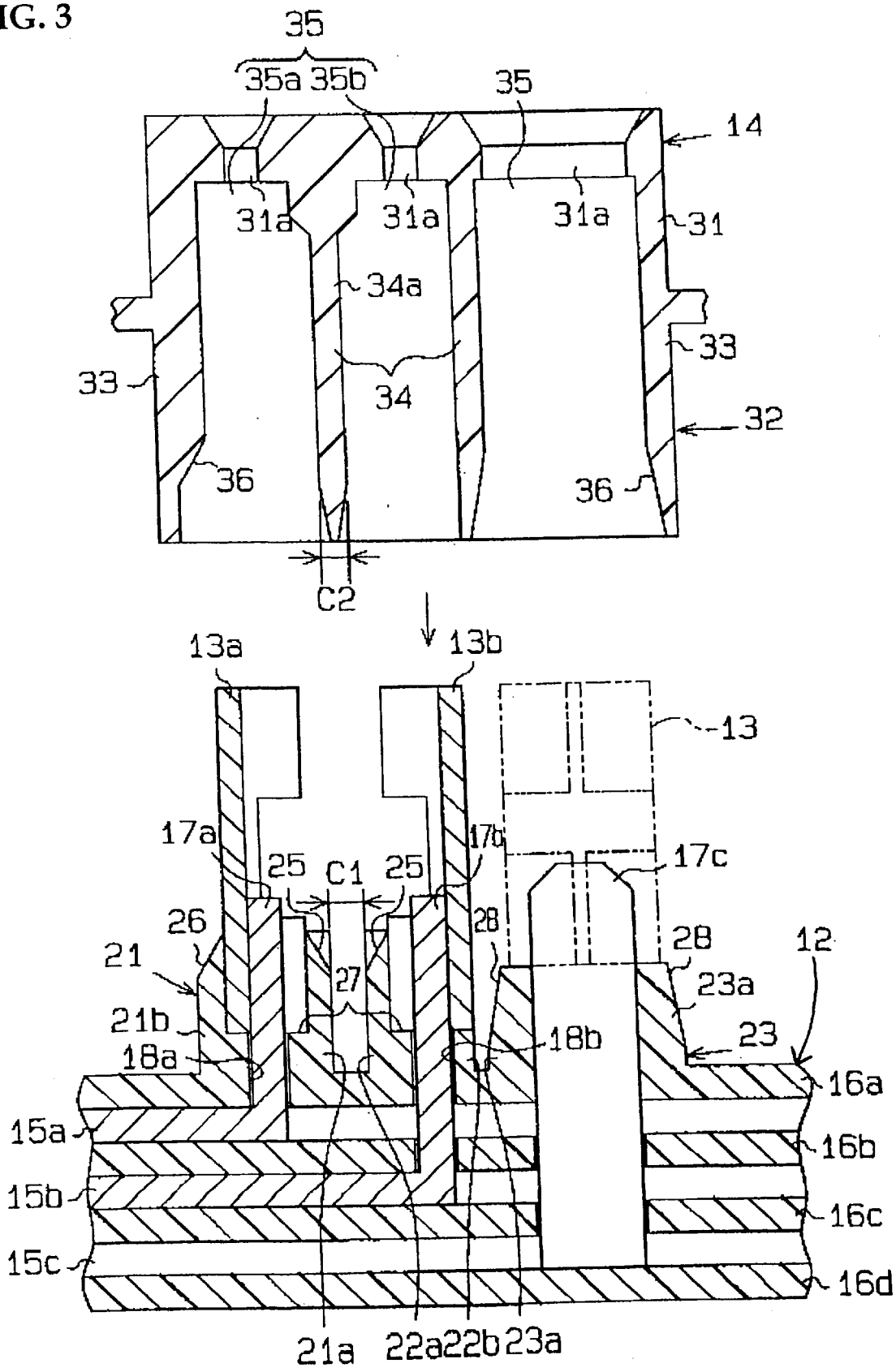
FIG. 3 is a sectional view on line A—A of FIG. 1.
Figure 4:
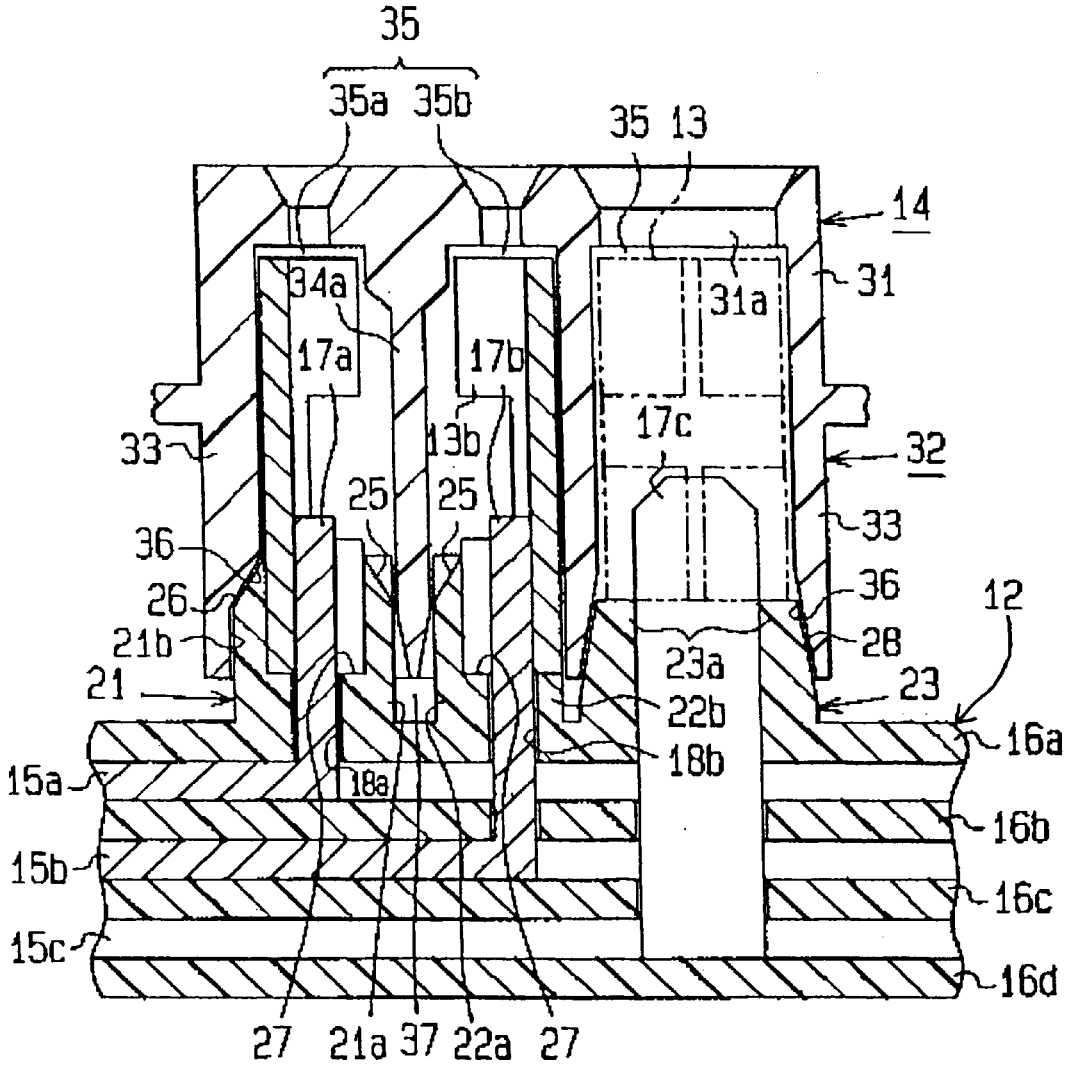
FIG. 4 is a sectional view corresponding to FIG. 3 when the circuit member and the case have been combined.
Figure 5:
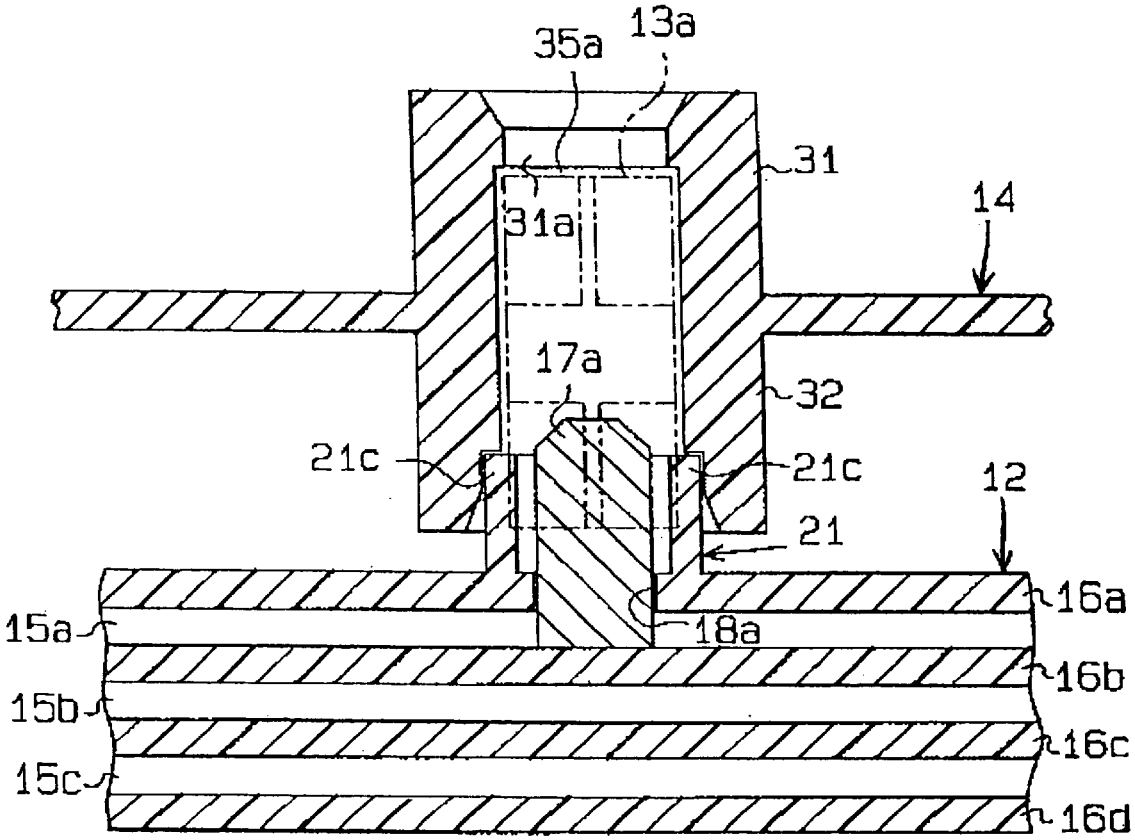
FIG. 5 is a sectional view on line B—B of FIG. 1.

On the topmost plate 16a, which may be a molded plastics component, wall structures 21–24 extend upward around the periphery of each aperture receiving a male tab 17*a*–17*d*. The wall structures 21 and 22 partially receive the relay terminals 13*a* and 13*b* respectively. The wall structure 21 has opposite end walls 21*c*, a side wall 21*b* remote from the wall structure 22 and a side wall 21*a* adjacent the wall structure 22. The wall structure 22 has opposite end walls 21*c*, a side wall 22*a* adjacent the wall structure 21 and of the same height as all the walls 21*a*, 21*b* and 21*c* thereof and a lower side wall 22*b* at its side remote from the wall structure 21. When the relay terminals 13*a* and 13*b* are fitted on the male tabs 17*a* and 17*b* they are held by the wall structures 21 and 22, as seen in FIGS. 3 to 5. Preferably the relay terminals 13*a* and 13*b* are received by the wall structures 21 and 22 for about ¼ to ⅓ of their height.

As shown in FIG. 3, the distance Cl between the side wall 21*a* and the side wall 22*a* is almost equal to a thickness C2 of a partition wall 34*a* of the case 14. A-sloping surface 25 (sloping downwardly away from the relay terminal 13*a*) is formed at the upper end of each of the side walls 21*a* and 22*a*. A sloping surface 26 (sloping downwardly away from the relay terminal 13*a*) is formed on the side wall 21*b*. A step 27 having a horizontal surface perpendicular to the direction of the male tab portions 17*a* and 17*b* is formed in the vicinity of the base of each of the wall structures 21 and 22 extending continuously around the apertures 18a and 18b. The lower ends of the relay terminals 13*a* and 13*b* fitted on the male tabs 17*a* and 17*b* are located on the horizontal surfaces of the steps 27. Sloping surfaces 28 (sloping downwardly away from the male tabs 17*c*) are formed at the upper ends of the wall structures 24.

As shown in FIG. 1, an installing zone 31 for an electrical or electronic component is provided at the outer side of the case 14 having through-holes 31*a* at positions corresponding to the male tabs 17*a*–17*d* respectively. As shown in FIG. 3, at the inside of the case 14, a terminal housing 32 has an outer side wall 33 surrounding all the relay terminals 13 and partition walls 34 separating the relay terminals 13 from each other. Thereby a plurality of compartments or accommodation spaces 35 are formed in the terminal housing 32. When the circuit member 12 and the case 14 are combined with each other, the spaces 35 accommodate the relay terminals 13 separately.

An outwardly inclined surface 36 is formed in the vicinity of the lower end of the inner surface of the outer side wall 33 of the terminal housing 32. The inclined surface 36 is in correspondence to the sloping surface 26 formed of the wall 21*b* and the sloping surfaces 28 and 29 of the wall structures 23 and 24. As shown in FIG. 4, when the circuit member 12 and the case 14 are combined with each other, the inclined surface 36 contacts the inclined surfaces 26, 28 and 29. In FIG. 4, to make the construction of the components of the case 14 clear, a slight gap is shown between the inclined surface 36 and the inclined surfaces 26, 28 and 29.

The partition wall 34*a* separating the spaces 35*a* and 35*b* accommodating the adjacent relay terminals 13*a* and 13*b* tapers toward its lower end. As shown in FIG. 4, when the circuit member 12 and the case 14 are combined, the partition wall 34*a* is inserted between the side walls 21*a* and 22*a*, slidably contacting the outer surface of the side walls 21*a* and 22*a*. The length of the partition wall 34*a* is such that a predetermined space 37 is formed surrounded by the side walls 21*a*, 22*a* and the partition wall 34*a*. In FIG. 4, to illustrate the construction more clearly, a slight gap is shown between the partition wall 34*a* and the side walls 21*a* and 22*a*.

When the circuit member 12 and the case 14 are united with each other, a component 38 (a relay in this embodiment) is mounted on the zone 31 with its connection terminals 38*a* inserted into the corresponding through-holes 31*a*. The connection terminals 38*a* are fitted in the respective relay terminals 13 to connect the relay 38 and the male tabs 17*a*–17*d* electrically. In use the electrical connection box 11 is mounted in a vehicle compartment, with the case 14 combined with a lower case (not shown) to mount and enclose the circuit member 12.

In the embodiment described above, effects such as the following are obtained.

(1) The walls 21–24 project up around the periphery of each aperture of the uppermost insulating plate 16*a*. When the circuit member 12 and the case 14 are combined, the side walls 21*a* and 22*a* slidably contact the side surfaces of the partition wall 34*a*, so that the spaces 35*a* and 35*b* accommodating the relay terminals 13*a* and 13*b* respectively are well separated from each other. Thereby, even if water penetrates into the terminal housing, the risk of a leak current between the relay terminals 13*a* and 13*b* is minimized. The walls 21 and 22 surround the relay terminals 13*a* and 13*b* over the lower part of their height, providing an elongated surface path between the relay terminals 13*a* and 13*b*. This helps to prevent a current leak between the relay terminals 13*a* and 13*b*.

The inclined surfaces 25 at the upper ends of the side walls 21*a* and 22*a* slope towards the partition wall 34, so that water flowing from above down the partition wall 34*a* flows easily into the space 37 and not into the circuit member 12. This helps prevent the generation of current leaks in the circuit member 12. It is simple to provide a construction for discharging water which has passed into the space 37 to the outside of the circuit member 12. The collection of water in the space 37 also helps to prevent a current leak from being generated between the relay terminals 13*a* and 13*b*.

In recent years, as increasing numbers of electric and electronic parts are mounted on a vehicle body, the tendency is to adopt a battery voltage of 42V. Thus, prevention of the generation of current leaks has become more important.

(2) The steps 27 having a horizontal upper surface perpendicular to the direction of the male tabs 17*a* and 17*b* are formed in the vicinity of the base of the wall structures 21 and 22 around the apertures 18*a* and 18*b* and locate the ends of the relay terminals 13*a* and 13*b*. Thereby the relay terminals 13*a* and 13*b* are stably positioned, making it possible to prevent deformation of the male tabs 17*a* and 17*b* and the relay terminals 13*a* and 13*b*. Inaccuracy in location of the relay terminals 13*a* and 13*b* is also prevented. Further, by appropriately choosing the height of the horizontal surface of the steps 27, it is possible to freely select the height location of the relay terminals 13*a* and 13*b*. Thus it is possible to make the height positions of the relay terminals 13*a* and 13*b* uniform, even if the relay terminals 13 to be mounted on the male tabs 17*a*–17*d* are of different types and even if the height dimensions of the relay terminals 13 are different.

(3) Since the inclined surface 36 in the vicinity of lower end of the inner surface of the outer side wall 33 of the terminal housing 32 widens downwardly, water flow from above on the inner surface of the side wall 33 can be discharged easily to the outside. Water is therefore not likely to collect in the terminal housing 32. This reduces the risk of current leakage.

The partition wall 34*a* is thinner toward its lower end, so that when the circuit member 12 and the case 14 are joined, the partition wall 34*a* can be easily inserted into the space between the side walls 21*a* and 22*a*.

Some possible modifications of the illustrated embodiment of the present invention are as follows:

In the illustrated embodiment, the inclined surfaces 25 slope upwardly gradually away from the partition wall 34*a*, but the surfaces 25 may be formed in such a way that they gradually converge towards the partition wall 34*a* toward their upper ends. This construction allows water, which flows from above along the partition wall 34*a*, to easily pass to the aperture 18 along the surfaces 25. That is, it is difficult for the water to penetrate into the gap between the partition wall 34*a* and the side walls 21*a* and 22*a*. Thereby it is possible to prevent a current leak between the relay terminals 13*a* and 13*b*.

An inclined surface like the inclined surface 26 may be formed on the tops of the side walls 21*c* of the wall structure 21 and the side walls 22*c* of the wall structure 22.

It is possible to omit the formation of the steps 27 in the vicinity of the base of the wall structures 21 and 22 in order to simplify the construction of the insulating partitioning plate 16*a*.

It is possible to omit the formation of the inclined surface 36 on the outer side wall 33. Further, the partition wall 34*a* may be formed with the same thickness at its upper and lower ends.

In the illustrated embodiment, the side walls 21*a* and 21*b* are formed to the same height, but the side wall 21*b* may be formed lower than the side wall 21*a*. Even if water may collect in the portion surrounded by the wall 21, it is discharged to the outside from the gap between the side wall 21*b* and the outer side wall 33. Therefore, the water level does not become higher than the side wall 21*b*. In this case, it is possible to reduce the possibility that water passes between the side wall 21*a* and the partition wall 34*a*. This helps to prevent a current leak between the relay terminals 13*a* and 13*b*.

In the illustrated embodiment, when the circuit member 12 and the case 14 are combined, the inclined surface 36 of the outer side wall 33 contacts the inclined surfaces 26, 28 and 29. But it is possible to form a gap between the inclined surface 36 and each of the surfaces 26, 28 and 29 in the assembled state. This construction also allows water or the like to be discharged effectively to the outside via the gaps.

In one embodiment, the wall structures 21 and 22 are formed to accommodate ¼–⅓ of the height of relay terminals 13*a* and 13*b* respectively, but this height overlap is not limited to this range.

The wall structures 21 and 22 may be constructed of only the side walls 21*a* and 22*a* close to each other. That is, the wall structures 21 and 22 may be provided only between two closely adjacent apertures 18.

The electrical connection box 11 may be used for an industrial robot or the like, other industrial product, as well as on a vehicle.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

What is claimed is:

1. An electrical connection box, comprising:

a plurality of bus bars providing at least two upstanding tabs acting as terminals;

a plurality of relay terminals fitted on said tabs;

an insulation plate overlying said bus bars and having respective apertures through which said tabs project and further having at least one upstanding wall located between said apertures and having an inclined upper end face, and a case member covering said insulation plate and assembled on said insulation plate by downward movement relative thereto, said case member having walls providing respective housing spaces for said relay terminals, said walls including a partitioning wall separating an adjacent pair of said housing spaces, wherein said partitioning wall is arranged to make sliding contact with said upstanding wall during said downward movement and said partitioning wall and said upstanding wall in the assembled state at least partly surrounds a liquid-receiving space.

2. An electrical connection box according to claim 1, wherein in the assembled state said inclined upper end face of said upstanding wall slopes upwardly away from said partitioning wall.

3. An electrical connection box according to claim 1, wherein said at least one upstanding wall comprises two upstanding walls arranged alongside each other between said apertures, and said partitioning plate is slidably received between said two upstanding walls, said liquid-receiving space being located between said two upstanding walls below said partitioning wall.

4. An electrical connection box according to claim 1, wherein said upstanding wall has a step providing a horizontal surface, at least one said relay terminal being located on said horizontal surface of said step.

5. An electrical connection box according to claim 1, wherein said walls of said case member further include at least one outer side wall bounding said housing spaces, said outer side wall having an inclined inner face portion which slopes upwardly and inwardly with respect to said housing spaces.

6. An industrial product having an electrical junction box, the electrical junction box comprising:

a plurality of bus bars providing at least two upstanding tabs acting as terminals;

a plurality of relay terminals fitted on said tabs, an insulation plate overlying said bus bars and having respective apertures through which said tabs project and further having at least one upstanding wall located between said apertures and having an inclined upper end face; and a case member covering said insulation plate and assembled on said insulation plate by downward movement relative thereto, said case member having walls providing respective housing spaces for said relay terminals, said walls including a partitioning wall separating an adjacent pair of said housing spaces, wherein said partitioning wall is arranged to make sliding contact with said upstanding wall during said downward movement and said partitioning wall and said upstanding wall in the assembled state at least partly surrounds a liquid-receiving space.

7. An industrial product according to claim 6, wherein in the assembled state said inclined upper end face of said upstanding wall slopes upwardly away from said partitioning wall.

8. An industrial product according to claim 6, wherein said at least one upstanding wall comprises two said upstanding walls arranged alongside each other between said apertures, and said partitioning plate is slidably received between said two upstanding walls, said liquid-receiving space being located between said two upstanding walls below said partitioning wall.

9. An industrial product according to claim 6, wherein said upstanding wall has a step providing a horizontal surface, at least one said relay terminal being located on said horizontal surface of said step.

10. An industrial product according to claim 6, wherein said walls of said case member further include at least one outer side wall bounding said housing spaces, said outer side wall having an inclined inner face portion which slopes upwardly and inwardly with respect to said housing spaces.

11. The industrial product according to claim 6, wherein the electrical junction box is mounted on a vehicle.

12. The industrial product according to claim 6, wherein the electrical junction box is mounted on a robot.

* * * * *